US006872924B2

(12) United States Patent
Eckert

(10) Patent No.: US 6,872,924 B2
(45) Date of Patent: Mar. 29, 2005

(54) ELECTRIC HEATER ASSEMBLY

(76) Inventor: C. Edward Eckert, 260 Lynn Ann Dr., New Kensington, PA (US) 15068

( * ) Notice: Subject to any disclaimer, the term of this patent is extended or adjusted under 35 U.S.C. 154(b) by 0 days.

(21) Appl. No.: 10/633,482

(22) Filed: Aug. 4, 2003

(65) Prior Publication Data

US 2005/0029251 A1 Feb. 10, 2005

(51) Int. Cl.[7] ..... H05B 3/60; H05B 3/10
(52) U.S. Cl. ..... 219/548; 338/225; 219/553
(58) Field of Search ..... 219/548, 523, 219/534, 538, 552, 553; 338/224, 225; 252/504, 509

(56) References Cited

U.S. PATENT DOCUMENTS 389,729 A * 9/1888 Weist ..... 338/225
412,449 A * 10/1889 Askew ..... 338/225
527,324 A * 10/1894 Davis ..... 219/553
543,800 A * 7/1895 Davis ..... 338/224
1,086,726 A * 2/1914 Opsahl ..... 338/224
1,263,181 A * 4/1918 Winger ..... 338/225
1,338,294 A * 4/1920 Gardner ..... 252/509
1,473,107 A * 11/1923 Kohn ..... 252/504
1,610,820 A * 12/1926 Steward et al. ..... 252/509
1,681,736 A * 8/1928 Kull ..... 219/552
1,947,692 A * 2/1934 Beyer ..... 252/504
2,905,919 A * 9/1959 Lorch et al. ..... 338/224
5,850,073 A * 12/1998 Eckert ..... 219/523

* cited by examiner

*Primary Examiner*—Teresa J. Walberg
(74) *Attorney, Agent, or Firm*—Andrew Alexander

(57) ABSTRACT

An electric assembly using powdered media for generating heat.

10 Claims, 3 Drawing Sheets

ELECTRIC HEATER ASSEMBLY

BACKGROUND OF THE INVENTION

This invention relates to electric heaters, and more particularly, it relates to electric heaters using novel heating means suitable for use in molten metals such as molten aluminum.

In the prior art, electric heaters used for molten aluminum are usually enclosed in ceramic tubes. Such electric heaters are very expensive and are very inefficient in transferring heat to the melt because of the air gap between the heater and the tube. Also, such electric heaters have very low thermal conductivity values that are characteristic of ceramic materials. In addition, the ceramic tube is fragile and subject to cracking. Thus, there is a great need for an improved electric heater suitable for use with molten metal, e.g., molten aluminum, which is efficient in transferring heat to the melt. The present invention provides such an electric heater.

SUMMARY OF THE INVENTION

It is an object of the invention to provide an improved electric heater assembly.

It is another object of the invention to provide an improved electric heater assembly for use in molten metal such as molten aluminum.

Yet, another object of this invention is to provide an improved electric heater assembly for use in molten metal, the electric heater assembly having a protective sleeve that has intimate physical contact with the heating media.

And yet, another object of the invention is to provide an improved electric heater assembly for use in molten metal, the electric heater assembly having a protective sleeve having a thermal conductivity of less than 30 BTU/ft hr° F. and having a thermal expansion coefficient of less than $15\times10^{-6}$ in/in/° F. and having a chilling power of less than 5000 $BTU^2/ft^4hr°$ F.

And yet, it is a further object of the invention to provide an improved electric heater assembly for use in molten metal, the electric heater assembly having a protective sleeve comprised of a material resistant to erosion or dissolution by molten metal such as molten aluminum.

These and other objects will become apparent from the specification, drawings and claims appended hereto.

In accordance with these objects, there is disclosed an improved electric heater assembly suitable for heating molten metal. The electric heater assembly is comprised of a sleeve having a closed end suitable for heating molten metal, the sleeve fabricated from a composite material comprised of titanium or titanium alloy and having an outside surface to be exposed to the molten metal coated with a refractory resistant to attack by the molten metal. A novel electric heating material is located in the sleeve in heat transfer relationship therewith for adding heat to the molten metal.

DETAILED DESCRIPTION OF PREFERRED EMBODIMENTS

Figure 1:
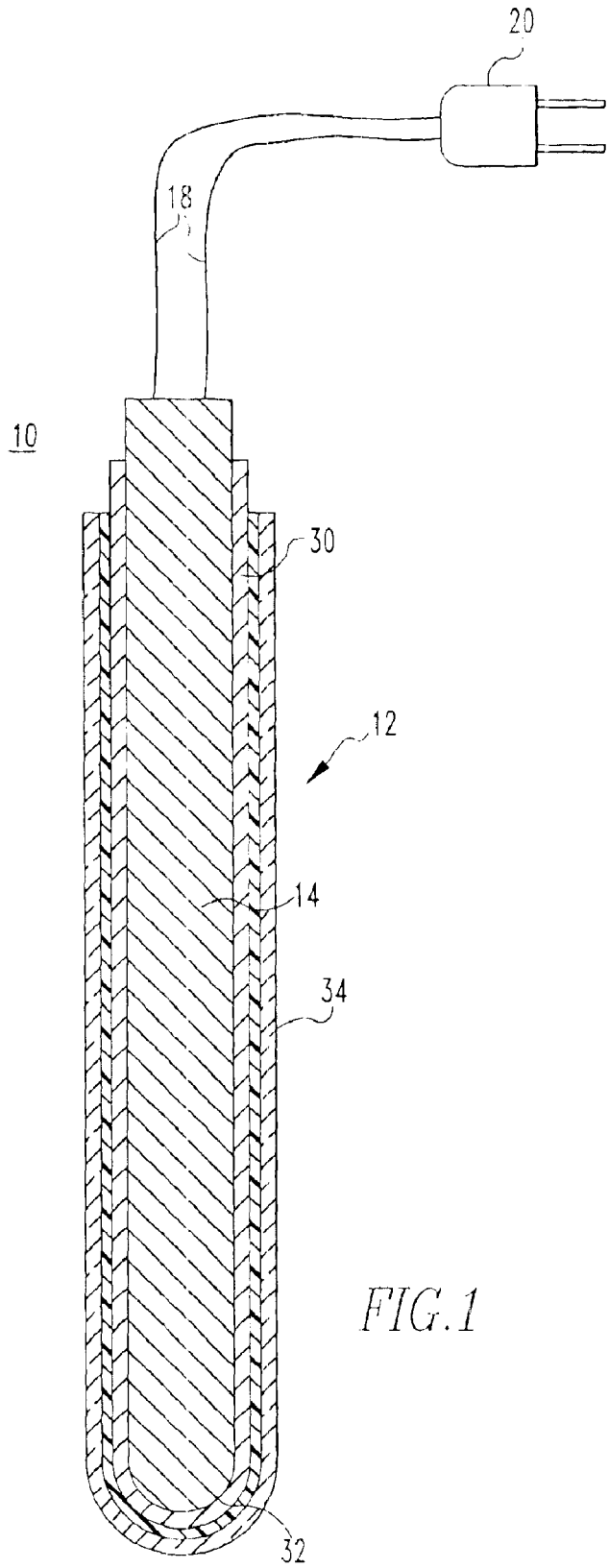
FIG. 1 is a cross-sectional view of an electric heater assembly in accordance with the invention.

Referring to FIG. 1, there is shown a schematic of an electric heater assembly 10 in accordance with the invention.

The electric heater assembly is comprised of a protective sleeve 12 and an electric heating element 14 when the heater is used for heating molten metal. A lead 18 extends from electric heating element 14 and terminates in a plug 20 suitable for plugging into a power source.

Preferably, protective sleeve 12 is comprised of titanium tube 30 having a closed end 32. While the protective sleeve is illustrated as a tube, it will be appreciated that any configuration that protects or envelops electric heating element 14 may be employed. Thus, reference to tube herein is meant to include such configurations. A refractory coating 34 is employed which is resistant to attack by the environment in which the electric heater assembly is used. A bond coating may be employed between the refractory coating 34 and titanium tube 30.

While it is preferred to fabricate tube 30 out of a titanium base alloy, tube 10 may be fabricated from any metal or metalloid material suitable for contacting molten metal and which material is resistant to dissolution or erosion by the molten metal. Other materials that may be used to fabricate tube 30 include silicon, niobium, chromium, molybdenum, combinations of NiFe (364 NiFe) and NiTiC (40 Ni 60TiC), particularly when such materials have low thermal expansion and low chilling power, all referred to herein as metals. For protection purposes, it is preferred that the metal or metalloid be coated with a material such as a refractory resistant to attack by molten metal and suitable for use as a protective sleeve.

Further, the material of construction for tube 30 should have a thermal of less than 30 BTU/ft hr° F., and preferably less than 15 BTU/ft hr° F., with a most preferred material having a thermal conductivity of less than 10 BTU/ft hr° F. Another important feature of a desirable material for tube 30 is thermal expansion. Thus, a suitable material should have a thermal expansion coefficient of less than $15\times10^{-6}$ in/in° F. with a preferred thermal expansion coefficient being less than $10\times10^{-6}$ in/in° F., and the most preferred being less than $5\times10^{-6}$ in/in/° F. Another important feature of the material useful in the present invention is chilling power. Chilling power is defined as the product of heat capacity, thermal conductivity and density. Thus, preferably the material in accordance with the invention has a chilling power of less than 5000 $BTU^2/ft^4hr°$ F., preferably less than 2000 $BTU^2/ft^4$ hr° F., and typically in the range of 100 to 750 $BTU^2/ft^4hr°$ F.

As noted, the preferred material for fabricating into tubes 30 is a titanium base material or alloy having a thermal conductivity of less than 30 BTU/ft hr° F., preferably less than 15 BTU/ft hr° F., and typically less than 10 BTU/ft hr° F., and having a thermal expansion coefficient less than $15\times10^{-6}$ in/in/° F., preferably less than $10\times10^{-6}$ in/in/° F., and typically less than $5\times10^{-6}$ in/in/° F. The titanium material or alloy should have chilling power as noted, and for titanium, the chilling power can be less than 500, and preferably less than 400, and typically in the range of 100 to 300 $BTU/ft^2hr°$ F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements, the chilling power and the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The titanium-base alloy can be a titanium selected from the group consisting of 6242,1100 and commercial purity (CP) grade. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 A, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt.%, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt.%, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material, which provides the tube with a molten metal resistant coating. The refractory coating can vary, depending on the molten metal. Thus, a novel composite material is provided permitting use of metals or metalloids having the required thermal conductivity and thermal expansion for use with molten metal, which heretofore was not deemed possible.

When the electric heater assembly is to be used for heating molten metal such as aluminum, magnesium, zinc, or copper, etc., a refractory coating may comprise at least one of alumina, zirconia, yttria stabilized zirconia, magnesia, magnesium titanite, or mullite or a combination of alumina and titania. While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitride may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 nils, and typically it is less than 2 mils.

The heater assembly of the invention can operate at watt densities of 40 to 120 watts/in$^{2}$.

The heater assembly in accordance with the invention has the advantage of a metallic-composite sheath for strength and improved thermal conductivity. The strength is important because it provides resistance to mechanical abuse and permits an ultimate contact with the internal element. Intimate contact between heating element and sheath inside diameter provides for substantial elimination of an annular air gap between heating element and sheath. In prior heaters, the annular air gap resulted in radiation heat transfer and also backs radiation to the element from inside the sheath wall which limits maximum heat flux. By contrast, the heater of the invention employs an interference fit that results in essentially only conduction.

In conventional heaters, the heating element is not in intimate contact with the protection tube resulting in an annular air gas or space there between. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The heater assembly is capable of operating at watt densities of 40 to 120 watts/in$^2$. The low coefficient of expansion of the composite sheath, which is lower than the heating element, provides for intimate contact of the heating element with the composite sheath.

In another feature of the invention, a thermocouple (not shown) may be inserted between sleeve 12 and heating element 14. The thermocouple may be used for purpose of control of the heating element to ensure against overheating of the element in the event that heat is not transferred away sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

Figure 2:
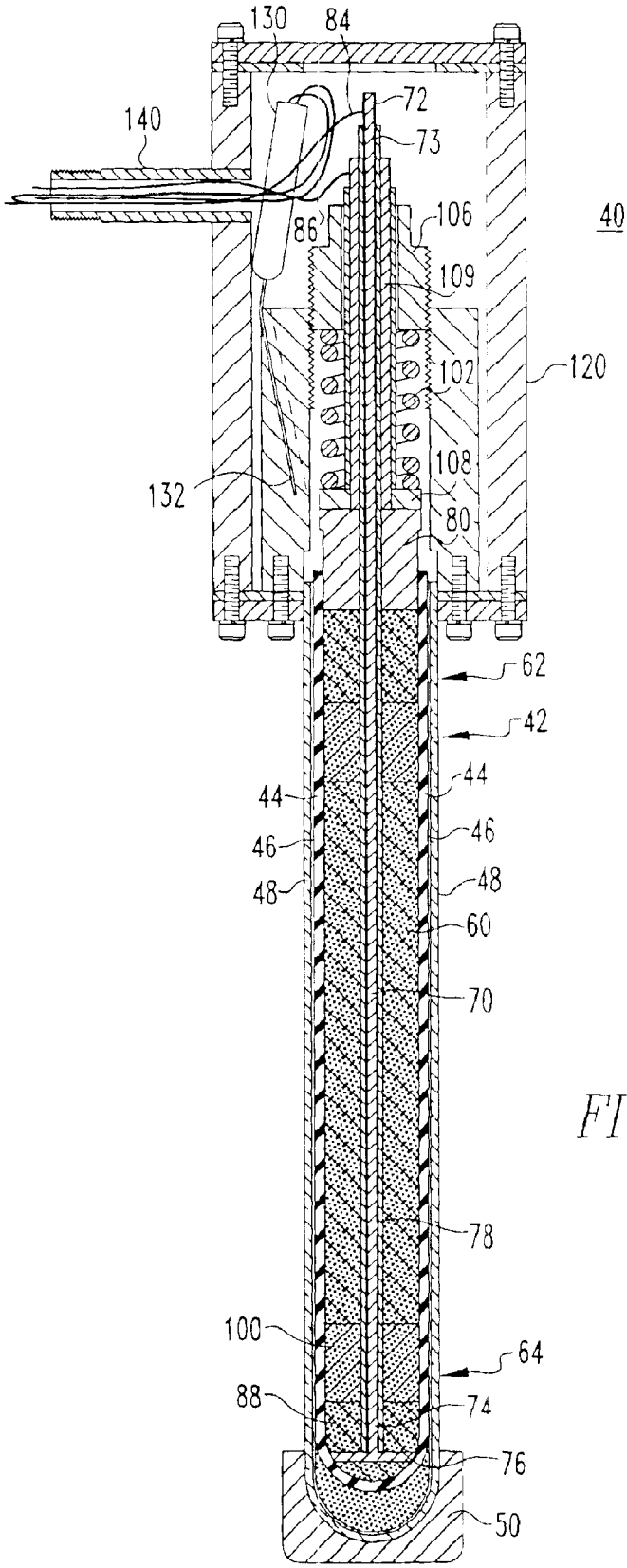
FIG. 2 is a cross-sectional view of an electric heater assembly employing compacted powdered heating media in accordance with the invention.

Another embodiment of the heater is shown in FIG. 2. Heater 40 comprises a tube 42. In the embodiment shown in FIG. 2, tube 42 is comprised of an electrical insulating or dielectric inside surface layer 44, a metal or metalloid layer 46 and molten metal protective layer 48. The molten metal protective layer is only necessary when the heater is used for heating molten metal such as molten aluminum, which would attack the metal layer 46.

Metal layer 46 can be comprised of any metal. However, when a refractory or protective layer is applied, it is preferred to use a metal or metalloid having a low coefficient of expansion such as referred to herein. Also, molten metal protective layer or refractory 48 may be the same as referred to herein. Further, protective layer 48 may be applied as described herein.

When tube 42 is comprised of a metal layer 46, then electrical insulating layer 44 is required on the inside surface to prevent the heater from short circuiting.

Any high thermal conductivity electrical insulating layer, which electrically isolates the metal from the heating element, may be used. Typical electrical insulating layers are comprised of alumina, magnesia, mullite, silicon carbide, silicon nitride and SiAlON. These layers may be applied by casting in-place, spray deposition, or mechanical insertion of a pre-cast or extruded form. Such layers usually have a total thickness in the range of 10 to 500 mils.

In the embodiment shown in FIG. 2, an end cap 50 is used to protect the end of the heater tube. End cap 50 may be comprised of a refractory or carbon material.

The heater of the invention employs a powdered media 60 as the electrical resistive material for generating heat on the passage of electrical current there through. In the embodiment shown in FIG. 2, the powdered media extends from an upper portion of the tube referred generally as 62 to lower portion of tube referred to generally as 64. Any powdered material may be used that has the characteristics to generate heat on the passage of electric current. Preferably, the powdered media has an electrical resistivity in the range of 3 to 95Ω-mm and typically a resistivity in the range of 8 to 30Ω-mm. The powdered media may comprise a mixture of an electrically conductive powder such as carbon and an electrically non-conductive powder such as silicon carbide. Thus, the powdered media may be comprised of a powder selected from the group consisting of SiC, C, Mo, TiN, $MoSi_2$, $Al_2O_3$, MgO, $TiB_2$, $Si_3N_4$, $TiO_2$ and BN. One or more of these powders may be mixed or combined to provide the desired resistivity. For example, carbon powder may be combined with at least one of SiC, $Si_3N_4$, $SiO_2$ and BN powder. When carbon is used as the electrical conductive media, it may be present in the range of 8 to 30 vol. % and typically in the range of 12 to 24 vol. %, depending on the resistivity desired. A typical media can comprise 22 wt. % carbon and 78 wt. % SiC. Because of the high temperatures that can be obtained with the heaters of the invention, it is important to have media with high melting points. Thus, the powdered media can have a melting point up to 4000° C., for example, and the melting point can range from about 800° to 4000° C., depending on the media.

In order to provide for packing of the powder in tube 42, the powdered media should have good packing density. The powder media can have an average particle size ranging from about 5 to 3000 μm. When a mixture of carbon and SiC is used, the carbon component of the powdered media has an average size range of about 0.5 to 60 μm, and the SiC particles have an average size of about 3 to 200 μm. Proper mixing of the components has been found to be an important consideration, and the preferred method for accomplishing this is to use a splitter.

Thus, it will be seen that in the present invention, the powdered media comprises the electrical heating element or member for the heater.

In the embodiment shown in FIG. 2, an electrical current feed post 70 is shown extending from top 72 to bottom 74, which terminates in a plate member 76. Post 70 is provided with an electrical insulating layer 78 to prevent electrical short-circuiting. In the embodiment shown, layer 78 extends from top 73 to plate member 76 and can comprise an alumina tube or layer. Other dielectric material may be used, such as referred to for use with inside tube 62. It will be noted that plate member 76 is not insulated and passes electric current to powdered media 60. Electric current passes through powdered media 60 and is removed from media 60 through member 80, which is concentric with post 70. Post 70 and member 80 are connected to an electrical power source via lines 84 and 86. To avoid overheating at the interface between plate member 76 and member 80, a media having lowered electrical resistivity is provided. In FIG. 2, the resistivity is shown being increased in two steps going from a low resistivity media 88 such as carbon to a higher resistivity media such as a 50 wt. % carbon, 50 wt.% SiC media before contacting resistive media 60.

Figure 3:
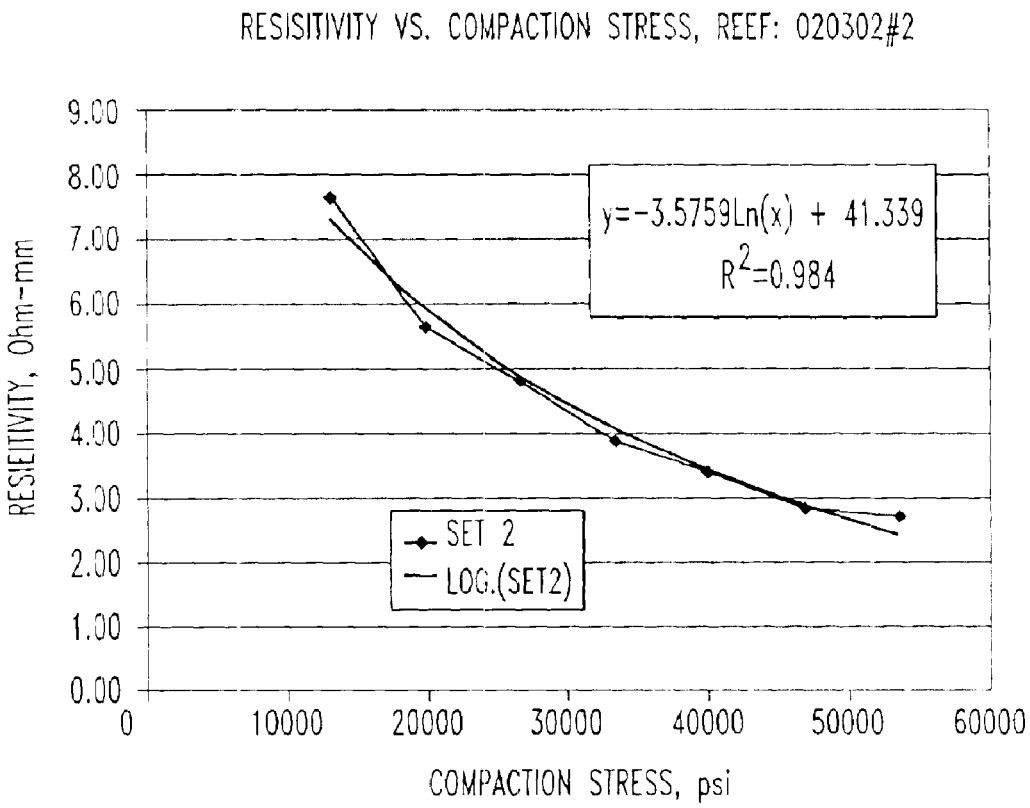
FIG. 3 is a graph showing changes in electrical resistance of powdered media with pressure.

It has been discovered that compaction stress is important to permit the powdered media to function as an electrical resistive heating element. That is, at a low compaction stress range, the resistivity of a particular powdered media composition is low and changes rapidly with increasing compaction stress (see FIG. 3). It is particularly desirable for the resistivity values to be a constant and repeatable as possible. This occurs at higher compaction stress values where it is believed that intimacy between the individual particles is high. Thus, for purposes of the invention, the stress applied to the powdered media should be applied in the range of 35,000 to 60,000 psi. It has also been discovered that throughout heater operation, the compaction stress values do not need to be maintained as high as during the initial compaction. Relatively low compaction stress can be applied and maintained as a pressure within the heater itself.

In the invention as illustrated in FIG. 2, pressure may be applied to the powdered media through spring 102. Pressure may be applied to spring 102 using threaded fastener 106. It should be noted that spring 102 compresses member 108 and is concentric with section 109 of member 80. It should be noted that member 108 is also formed from a dielectric material such as used on post 70 or on the inside of tube 42 in order to prevent short circuiting with metal tube 46.

A housing 120 is shown provided around spring 102 and top portion of heater 40. The housing can be purged with gas such as argon, which acts as a gettering agent for oxygen, or other gases released from the powdered media. Also, a thermocouple 130 having a probe 132 is shown located in housing 120. This may be used to provide control of the heat output and avoid overheating. Leads from the heater and thermocouple are removed through valve 140.

Rod 70 and member 80 may be comprised of titanium or other electrical conductive material. Because of the compressive forces applied to powdered media 60 by spring 102, it is preferred that dielectric layers 44 and 78 either be intimately bonded to the metal surface, for example, by plasma spraying or be flexible initially to avoid cracking as the powdered media is compacted.

While the invention has been described in terms of preferred embodiments, the claims appended hereto are intended to encompass other embodiments, which fall within the spirit of the invention.

Having described the presently preferred embodiments, it is to be understood that the invention may be otherwise embodied within the scope of the appended claims.

What is claimed is:

1. An electric heater assembly comprised of:

(a) a metal tubular-shaped container having an inside surface and having a layer of electrically insulating material on said inside surface, said layer having a thickness in the range of 10 to 500 mils, said tubular container having an upper portion and a lower portion;

(b) a compacted powdered heating media having a controlled electrical resistivity contained in said container extending between said upper portion and lower portion;

(c) a first electrical current conduction means contacting said upper portion of powdered media; and (d) an electric current feed conductor extending through said powdered media to a second electric current conduction means contacting said lower portion of said powdered media to permit electric current to flow from said first means through said powdered media to said second means, the electric current feed conductor having a layer of electrically insulating material on the surface thereof to prevent electrical short circuiting, the electrical resistivity of said media generating heat upon flow of said electric current.

2. The electric heater assembly in accordance with claim 1 wherein the resistivity of said powdered media ranges from 5 to 75 Ω-mm.

3. The electric heater assembly in accordance with claim 1 wherein the resistivity of said powdered media ranges from 10 to 55 Ω-mm.

4. The electric heater assembly in accordance with claim 1 wherein said powdered media comprises a powder selected from the group consisting of SiC, C, Mo, W, TiO2, $Si_3N_4$, SiO2 and BN.

5. The electric heater assembly in accordance with claim 1 wherein said powdered media comprises a mixture of an electrical conductive powder and an electrical non-conductive powder.

6. The electric heater assembly in accordance with claim 1 wherein said powdered media comprises a mixture of carbon powder and a powder selected from the group consisting of SiC, $TiO_2$, $Si_3N_4$, $SiO_2$ and BN.

7. The electric heater assembly in accordance with claim 1 wherein said powdered media comprises a mixture of carbon and SiC powder.

8. The electrical heater in accordance with claim 1 wherein said powdered media has a melting point in the range of 800° to 4000° C.

9. The electrical heater in accordance with claim 1 wherein said powdered media has an average particle size in the range of 5 to 3000 microns.

10. The electric heater assembly in accordance with claim 1 wherein said electrically insulating inside surface layer is comprised of alumina, magnesia, mullite, silicon carbide, silicon nitride or SiAlON.

* * * * *